US006435107B1

(12) United States Patent
Schmidt et al.

(10) Patent No.: US 6,435,107 B1
(45) Date of Patent: Aug. 20, 2002

(54) VARIABLE WORKSTATION FURNITURE SYSTEM HAVING A FURNITURE FRAME COMPRISED OF COLUMNS AND FOOT EXTENSIONS

(75) Inventors: Markus Schmidt, Betzdorf; Ala Jauch, Dinkelsbühl; Werner-Josef Kaiser, Elkenroth, all of (DE)

(73) Assignee: Otto Lampertz GmbH & Co. KG, Wallmenroth (DE)

( * ) Notice: Subject to any disclaimer, the term of this patent is extended or adjusted under 35 U.S.C. 154(b) by 0 days.

(21) Appl. No.: 09/807,821

(22) PCT Filed: Jan. 14, 1999

(86) PCT No.: PCT/EP99/07728

§ 371 (c)(1),
(2), (4) Date: Jul. 17, 2001

(87) PCT Pub. No.: WO00/22958

PCT Pub. Date: Apr. 27, 2000

(30) Foreign Application Priority Data

Oct. 21, 1998 (DE) ..... 198 48 398

(51) Int. Cl.[7] ..... A47B 37/00
(52) U.S. Cl. ..... 108/50.02; 248/188.9
(58) Field of Search ..... 312/194, 223.3, 312/223.6, 351.5, 351.7, 357.8; 108/50.02; 248/188.8, 188.9

(56) References Cited

U.S. PATENT DOCUMENTS

| | | | | |
|---|---|---|---|---|
| 5,237,935 A | * | 8/1993 | Newhouse et al. | 312/223.6 |
| 5,752,449 A | | 5/1998 | Simon et al. | |
| 6,029,587 A | * | 2/2000 | Rozier, Jr. et al. | 108/50.02 |
| 6,283,043 B1 | * | 2/2000 | Stern et al. | 108/50.02 |

FOREIGN PATENT DOCUMENTS

| | | |
|---|---|---|
| DE | 40 39 097 | 6/1991 |
| DE | 93 01 249 | 6/1993 |
| DE | 297 20 976 | 2/1998 |
| DE | 198 48 398 | 10/1999 |
| EP | 681 439 | 1/1994 |

* cited by examiner

*Primary Examiner*—Peter M. Cuomo
*Assistant Examiner*—Jerry A. Anderson
(74) *Attorney, Agent, or Firm*—Pauley Petersen Kinne & Erickson

(57) ABSTRACT

A variable workstation furniture system having a furniture frame with vertical columns and foot extensions, whereby the lower ends of the columns can be connected to base elements to which the front and rear foot extensions can be connected. The design of the foot is simplified by the parts and assembly, while broadening variation possibilities, so that the foot extensions and the foot intermediate pieces form an assembly. The front foot extensions facing the columns include a column receptacle as a base unit which is open in an upward manner and in which a column can be inserted and connected to the foot extension.

26 Claims, 8 Drawing Sheets

VARIABLE WORKSTATION FURNITURE SYSTEM HAVING A FURNITURE FRAME COMPRISED OF COLUMNS AND FOOT EXTENSIONS

BACKGROUND OF THE INVENTION

1. Field of the Invention

This invention relates to a variable workstation furniture system having a furniture frame, which can include vertical columns and foot extensions, wherein the lower ends of the columns can be connected with base elements, to which front and rear foot extensions can be connected.

2. Description of Related Art

A variable workstation furniture system is known from European Patent Reference EP 0 681 439 B1. There, the columns of the furniture frame as embodied as double supports, both of which are connected at their lower ends with a base element. Front and rear foot extensions of variable extensible length can be connected to the base elements.

Moreover, the two base elements for a double support are fixedly connected with each other via a base connector. Thus the design of the foot of a piece of workstation furniture in particular requires a considerable cost for parts and assembly. Furthermore, the design of the foot is limited to a single piece of work furniture and cannot be expanded to work furniture combinations.

It is one object of this invention to design the outlay for parts and assembly for the furniture frame of a variable workstation furniture system so that a further variation of the design of the foot is possible for work furniture combinations.

SUMMARY OF THE INVENTION

In accordance with this invention, this object is achieved with front foot extensions of different extension lengths, rear foot extensions and intermediate foot elements that form a kit. The front foot extension has as the base element a column receiver, which faces the column and is open at the top, into which a column can be inserted and can be connected with the front extension. A rear foot extension or an intermediate foot element can be connected to the column receiver of a front foot extension and can also be connected with the front foot extension.

With this embodiment of the front foot extension, the base elements are no longer separate elements, they are formed as one piece to the front foot extension. The remaining elements of the kit, rear foot extensions and intermediate foot elements, do not require any base elements, for example column receivers, and can be directly connected with the column receivers of front foot extensions. There, the intermediate foot elements offer the option of connecting two front foot extensions with each other, wherein two spaced-apart column receivers allow the construction of two pieces of workstation furniture which adjoin each other in the rear and which are connected with each other via common feet extending over the two pieces of furniture.

If an extension element, which is open toward the bottom, adjoins the column receiver and has a fastening receiver with a fastening flange and a nut receptacle in the area of the free end, a height adjustment device can be attached to the front foot extension.

The connection between the column and the column receiver is preferably provided by screwing them together, wherein in one embodiment, at least two fastening receivers with fastening flanges and nut receptacles, to which a column can be fixed by screws, are formed on a bottom of the column receiver.

In accordance with a further embodiment, the connection of a rear foot extension or of an intermediate foot element to the column receiver is accomplished with a fastening sleeve, which can be brought into congruence with a fastening plate of a rear foot extension, or of an intermediate foot element, and can be connected with it by a screw connection, that is formed on the free end of the column receiver. In this case the fastening and the alignment can be further improved because two plug-in receivers are formed in the area of the free end of the column receiver of a front foot extension, into which vertically upward oriented plug-in shoulders of a rear foot extension or of an intermediate foot element can be inserted.

First the plug-in connections are made, and then the two adjoining parts are screwed together.

If the intermediate foot elements have identical fastening plates and plug-in shoulders on both ends, the same as the fastening plates and plug-in shoulders of the rear foot extensions, an intermediate foot element can be connected at both ends with a column receiver of a front foot extension.

The rear foot extensions are designed as hollow bodies open toward the bottom and are reinforced by longitudinal and/or transverse strips. A fastening receiver with a fastening plate and a nut receptacle is formed on the free end of the rear foot extensions, so that they can be directly connected with a front foot extension and equipped with a height adjustment device.

An embodiment advantageous for the design of the foot extensions is visually sufficient because the rear foot extensions extend over a connecting element and an extension element, and the extension element, the same as the extension elements of the front foot extensions, are continuously reduced in structural height and width toward the free end.

If the intermediate foot elements are designed so that the intermediate foot elements extend over a connecting element, a center element and again a connecting element, wherein both connecting elements have identical fastening plates and identical plug-in shoulders, then they can be used in two positions for connecting front foot extensions, which simplifies and eases the construction of the furniture frame.

The intermediate foot elements can be produced cost-effectively and with sufficient strength if they are designed so that the connecting elements and the center element of the intermediate foot elements are hollow bodies open toward the bottom and are reinforced by longitudinal and/or transverse strips. The center element has a centered screw receiver with a threaded bore. Further elements can be fastened on the center element and the connecting elements of the intermediate foot element.

This invention can be used with columns designed as double supports because the column receiver of the front foot extensions is designed for insertion and connection with a double support.

If a fastening element, which extends horizontally away and has a vertical bore, to which a height adjustment device can be attached, is formed on the free end of the column receiver, it is also possible to have a height adjustment, or a compensation for uneveness of a bed in the area of the column receiver.

In another embodiment, the connection of a front and a rear foot extension, or of an intermediate foot element with front foot extensions, has horizontally oriented pins or pin receivers and screw receivers provided on a connecting face of the free end of the column receiver of a front foot extension. Pin receivers, or pins adapted as counter elements, as well as further screw receivers, are formed on a side of a rear foot extension, or of an intermediate foot element, facing the connecting face. The foot extensions, or foot extensions and intermediate elements, which are initially plugged into each other in an aligned manner can then be solidly fastened to each other simply with screws. In the process, an exact adjustment and a connection without play results because the pins and pin receivers are conically shaped.

BRIEF DESCRIPTION OF THE DRAWINGS

This invention is explained in greater detail in view of an exemplary embodiment represented in the drawings wherein.

DESCRIPTION OF PREFERRED EMBODIMENTS

Figure 1:
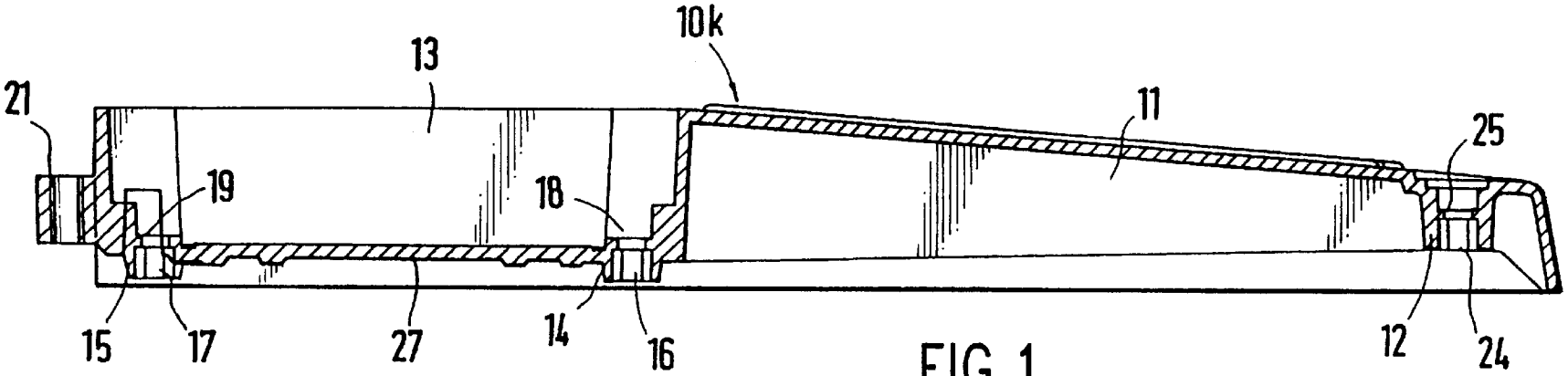
FIG. 1 is a longitudinal sectional view of a front foot extension of a short extension length.
Figure 2:
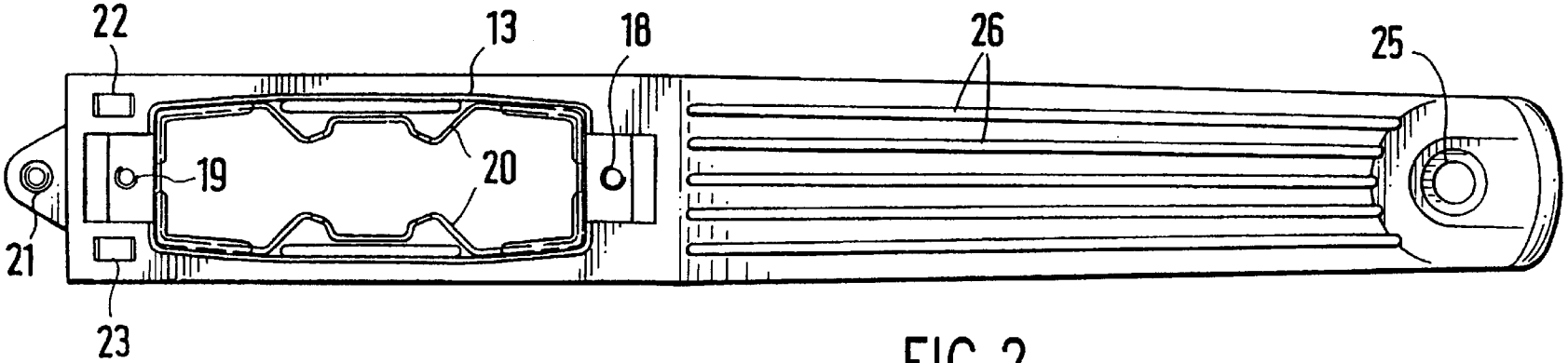
FIG. 2 is a top view of the front foot extension in accordance with FIG. 1.

As shown in FIG. 1, a column receiver 13 is formed as a column element at the end of a front foot extension **10*k* facing the column 20. The extension element 11 extending in the direction of the free end is hollow toward the bottom and continuously decreases in structural height and width toward the free end, as shown in the top view in FIG. 2. A sleeve-shaped fastening receiver 12 is formed in and on the free end, is closed at the top by means of a fastening plate 25 having a Fastening bore and is embodied as a nut receptacle 24 underneath the fastening plate 25. The fastening receiver 12 is used for attaching a height adjustment device. Longitudinally oriented strips 26 are formed on the extension element 11. The front extension 10*k*** and has a short extension length.

The column receiver 13 closed by means of the bottom 27 receives a column 20 embodied as a hollow profiled section, which is screwed into the column receiver 13. Thus, two fastening receivers 14 and 15, which are assigned to the narrow sides, are assigned in the embodiment, which are closed off at the top as fastening flanges 18 or 19 with a fastening bore, and are embodied as nut receptacle 16 and 17 underneath the fastening flanges 18 and 19. If the column 20 with the fastening flanges 18 and 19 has flush fastening flanges, then the column 20 can be screwed together with the column receiver 13 in a simple manner. The end wall of the column receiver 13 has a fastening sleeve 21 formed on it as a free end, and the end area of the cover wall has two plug-in receivers 22 and 23. The fastening sleeve 21 and the plug-in receivers 22 and 23 are connecting elements for a rear foot extension 30, or an intermediate foot element 40.

Figure 3:
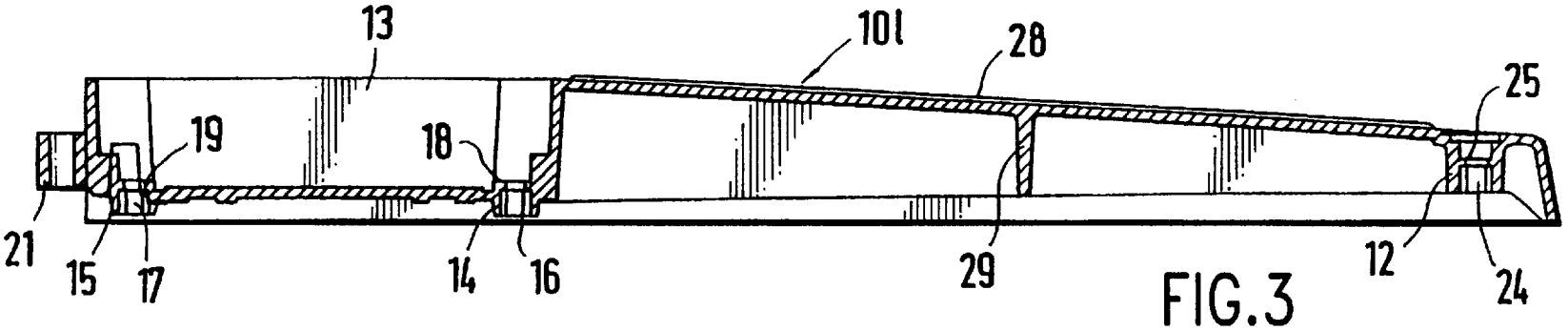
FIG. 3 is a longitudinal sectional view of a front foot extension of a great extension length in reduced scale.

The front foot extension 101 shown in a longitudinal sectional view in FIG. 3 has a greater extension length. The extension element 28 is longer, but has an identical column receiver 13 formed on it. All remaining elements of the front extension 101 are identical, as in the front extension **10*k* in accordance with FIGS. 1 and 2**.

Figure 4:
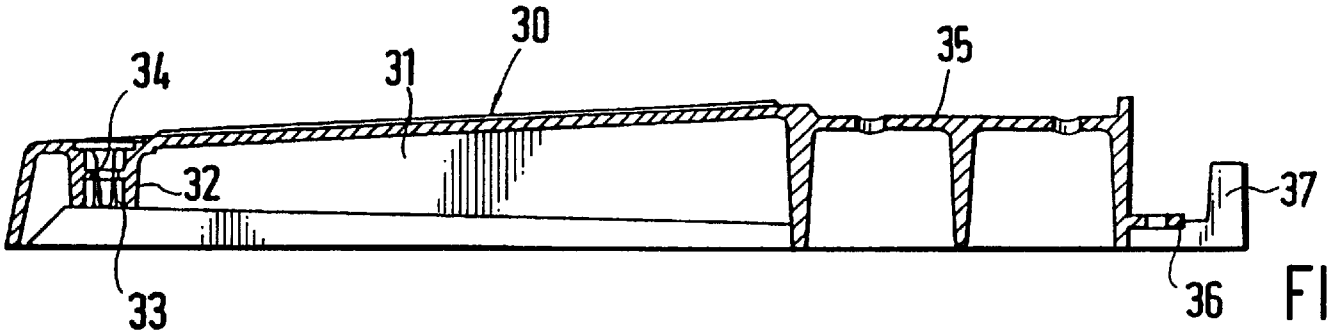
FIG. 4 is a longitudinal sectional view of a rear foot extension, which can be connected with the front foot extension in accordance with FIG. 1 or 3.
Figure 5:
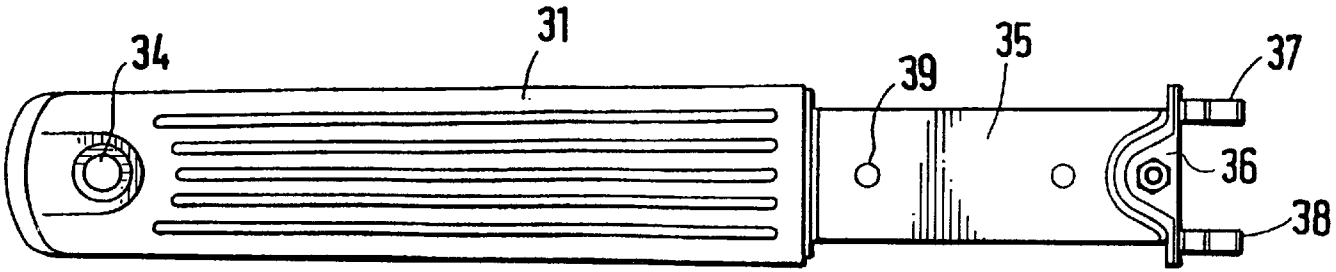
FIG. 5 is a top view of the rear foot extension in accordance with FIG. 4.

A rear foot extension 30 shown in a longitudinal sectional view in FIG. 4 and in a top view in FIG. 5, which can be connected with a column receiver 13 of a front foot extension **10*k* or 10*l*. Here, a center fastening plate 36 with a fastening bore and two lateral, upwardly oriented plug-in shoulders 37 and 38 are formed on the end facing the column receiver 13. The column receiver 13 of the front foot extension 10*k* or 10*l* can be plugged from above into the plug-in shoulders 37 and 38, and in the process they are inserted into the plug-in receivers 22 and 23. During this, the fastening bore of the fastening sleeve 21 also becomes aligned with fastening bore of fastening plate 36, so that both elements can be screwed to each other. A nut receptacle can also be formed underneath the fastening plate 36. A connecting element 35 with bores 39 adjoins the fastening plate 36 and subsequently makes a transition into the extension element 31, which again is continuously reduced in structural height and width toward the free end. The free end of the rear foot extension 30 also has a fastening receiver 32 with a fastening plate 34 and nut receptacle 33** for attaching a height adjustment device.

Figure 6:
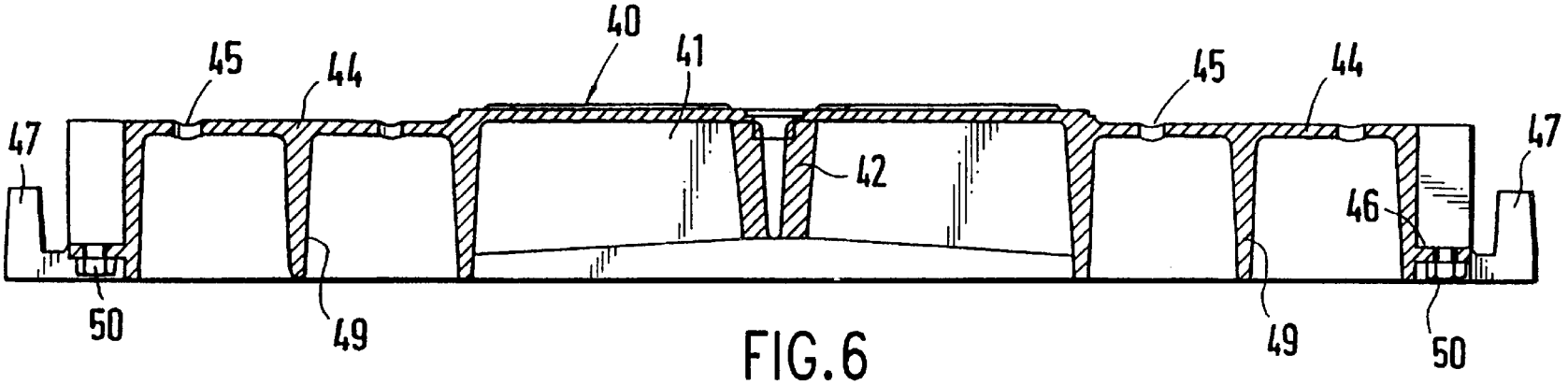
FIG. 6 is a longitudinal sectional view of an intermediate foot element with connecting elements on both ends for a connection with front foot elements.
Figure 7:
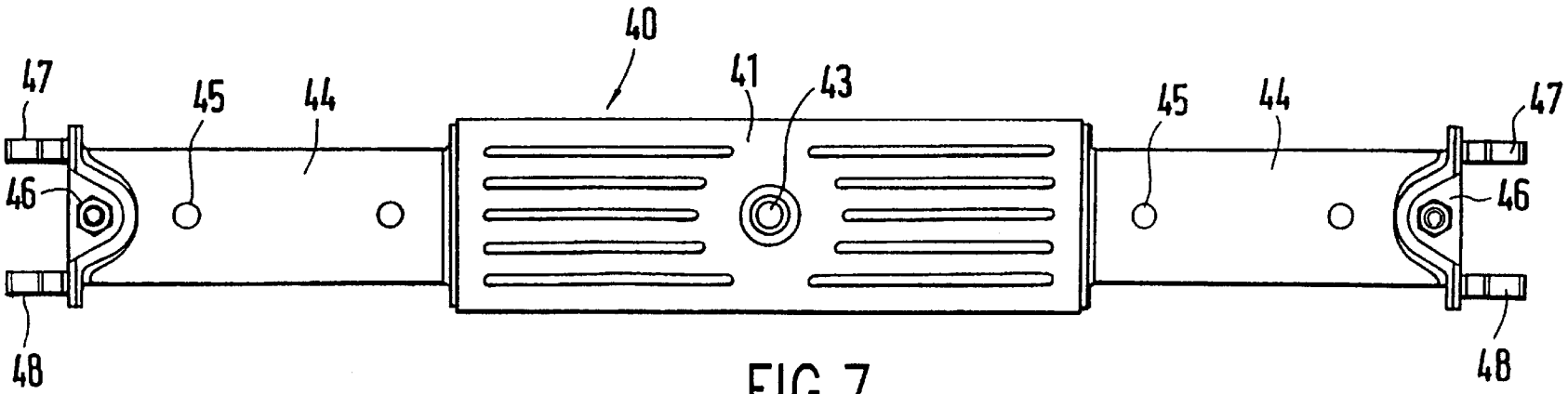
FIG. 7 is a top view of the intermediate foot element in accordance with FIG. 6.

An intermediate foot element 40 is shown in a longitudinal section view in FIG. 6 and in a top view in FIG. 7, which at both ends has fastening plates 46 and plug-in shoulders 47 and 48, so that front foot extensions **10*k* or 10*l* can be connected with their column receivers 13 at either end. Nuts 50 are shown underneath the fastening plates 46**, which can be held, secure against rotation, in formed-on nut receivers.

The intermediate foot element 40 is also embodied as a hollow body, open at the bottom, which can be reinforced by means of longitudinal and/or transverse strips, as the strips 49 show. The intermediate foot element 40 has a cuboid center element 41, which can have a screw receiver 42 with a threaded bore 43 in the center for being able to attach further elements. Connecting elements 44 with fastening bores 45 adjoin the center element 41 on both sides, so that further elements can be attached.

On their free ends, the connecting elements 44 terminate in fastening plates 46 with fastening bores and two upwardly oriented plug-in shoulders 47 and 48, the same as the rear foot extensions 30, so that a front foot extension 10*k* or 10*l* can be connected to either end of the intermediate foot element 40. Here, the fastening receivers 14 and 15 with the fastening flanges 18 and 19, as well as the nut receptacles 16 and 17 for screw connections, are used, and the plug-in shoulders 47 and 48 improve the connection of the two parts with each other after they are introduced into the plug-in receivers 22 and 23 of a column receiver 13. As the nuts 50 in FIG. 6 show, nut receptacles can also be formed underneath the fastening plates 46.

Figure 8:
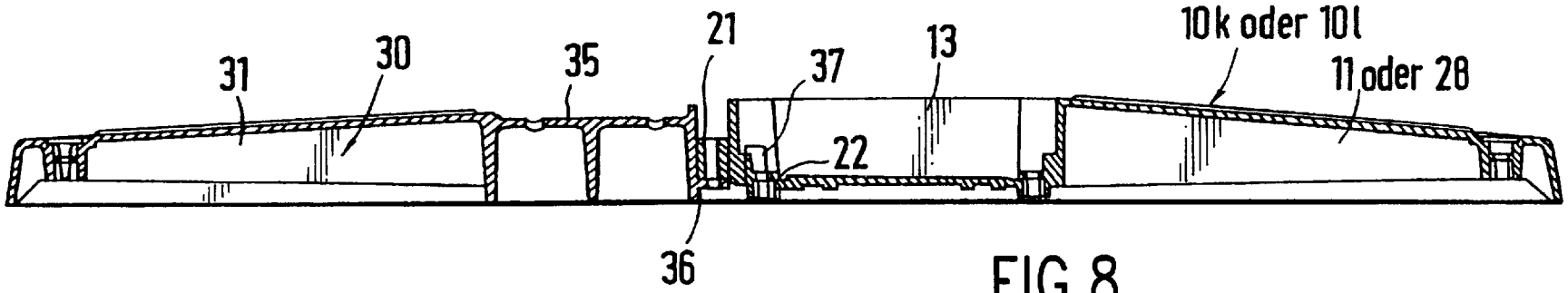
FIG. 8 is a longitudinal sectional view of a foot for a column, assembled from a front foot extension and a rear foot extension.
Figure 9:
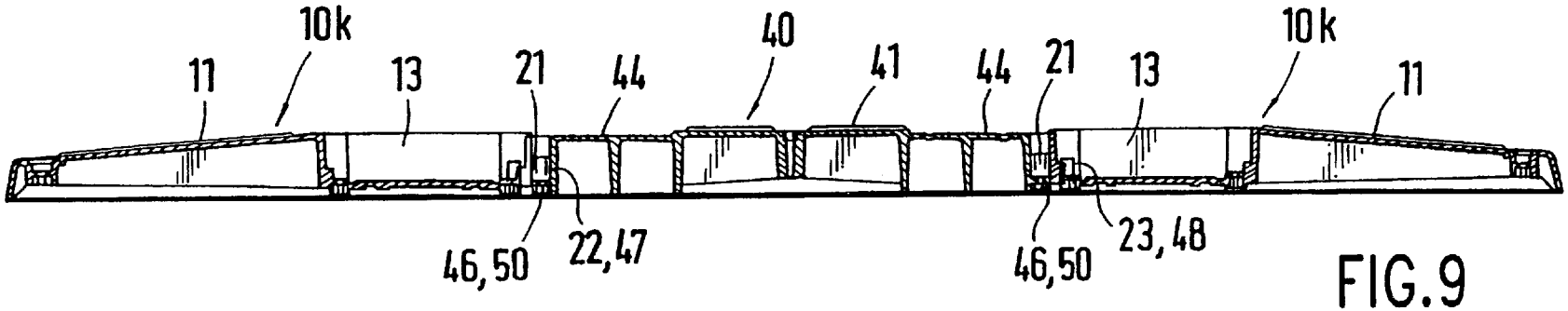
FIG. 9 is a longitudinal sectional view of a foot for a column, assembled from a front foot extension, an intermediate foot element and a rear foot extension for two spaced-apart columns of workstation firniture adjoining at the back.

The longitudinal sectional view in accordance with FIG. 8 represents a foot for a column 20 of a piece of workstation furniture, wherein the column 20 is inserted into the column receiver 13 of the front foot extension 10*k* or 10*l* and is screwed together with it. With its connecting element 35, a rear foot extension 30 adjoins the free narrow side wall of the column receiver 13, wherein the fastening sleeve 21 of the column receiver 13 and the fastening plate 36 of the rear foot extension 30 are aligned for being screwed together and are connected with each other. The plug-in shoulders 37 and 38, inserted into the plug-in receivers 22 and 23 of the plug-in receiver 13, improve the connection.

As shown in FIG. 7, it is also possible to connect an intermediate foot element 40 to the plug-in receiver 13 of a front foot extension 10*k* or 10*l*, wherein the fastening sleeve 21 of the plug-in receiver 13 and the fastening plate 46 of the intermediate foot element 40 allow screwing together of both parts, and the plug-in shoulders 47 and 48 in the plug-in receivers 22 and 23 form the additional plug-in connections. A further front foot extension 10*k* or 10*l* can be connected to the other connecting element 44 of the intermediate foot element 40, because identical fastening means and plug-in means for a screw connection and two plug-in connections are provided at the joint. A connecting element 44 meets a column receiver 13 of a front foot extension 10*k* or 10*l* on both sides of the intermediate foot element 40. Therefore the assembled foot has two column receivers 13 for two columns 20 of pieces of workstation furniture, which adjoin at their backs and whose distance is fixed by the intermediate foot element 40.

If the columns of the workstation furniture are embodied as double supports, the column receiver 13 can be embodied as double receiver and formed on the front foot extensions 10*k* and 10*l*, wherein both column receivers 13 are spaced-apart in accordance with the column spacing of the double receiver, and only the column receiver 13 facing the free end has a fastening sleeve 21 and the two plug-in receivers 22 and 23.

Figure 19:
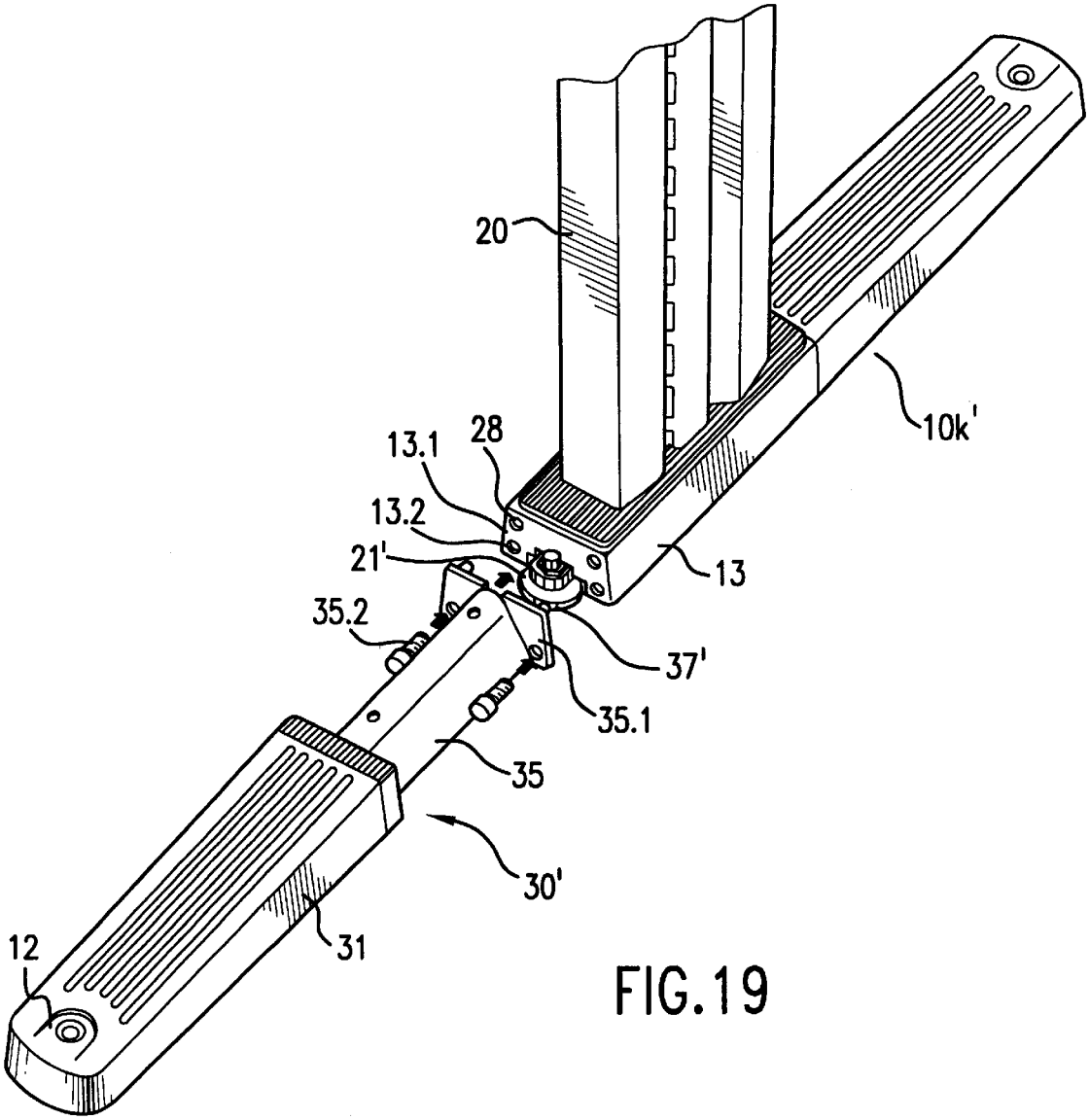
FIG. 19 is a perspective plan view of a foot structure with the foot extensions in accordance with FIGS. 10 to 15.

A further embodiment for the design of the short front (FIGS. 10 to 12), long front (FIG. 13) and the rear foot extension (FIGS. 14 and 15), as well as of the intermediate foot element 40' (FIGS. 16 to 18), is shown in FIGS. 10 to 19. FIG. 19 represents a perspective plan view of a foot structure with the further front foot extension 10*k'* and the rear foot extension 30'.

Figure 10:
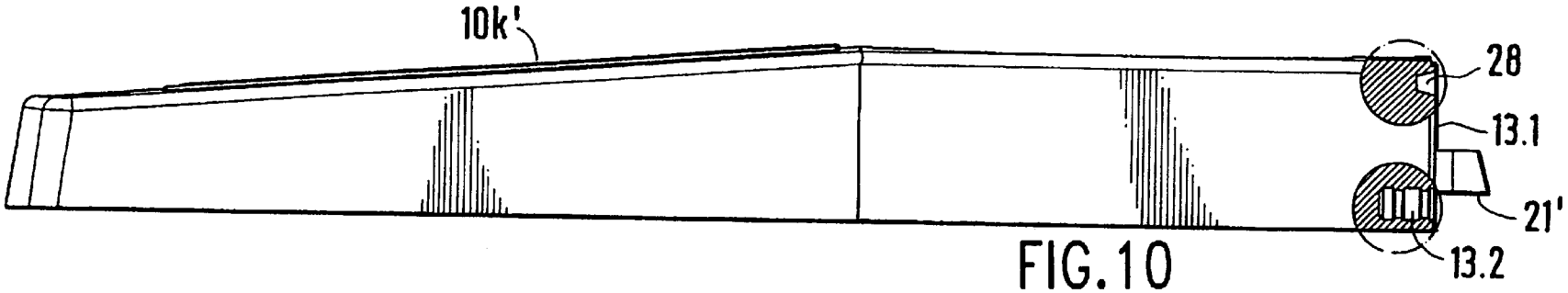
FIG. 10 is a further embodiment of a front foot extension in a partial sectional lateral view.
Figure 11:
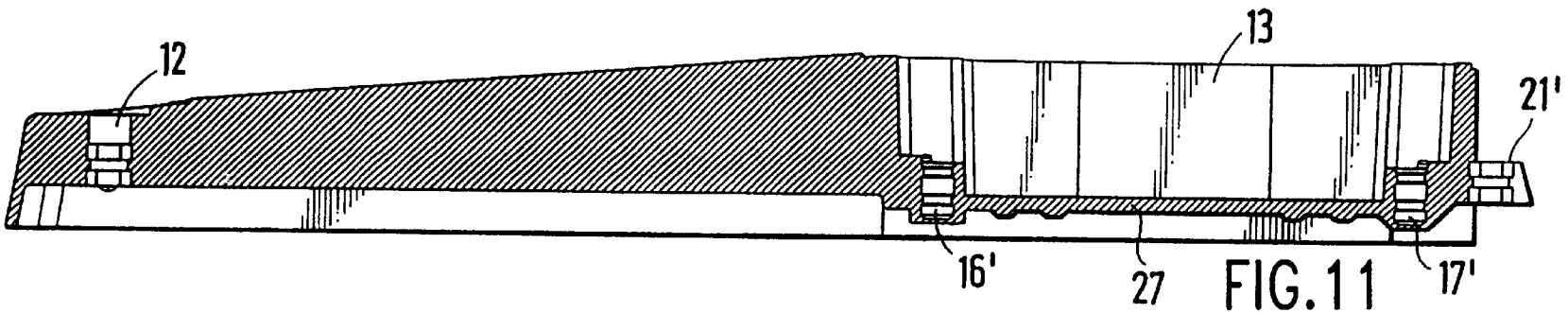
FIG. 11 is a longitudinal sectional view of the foot extension in accordance with FIG. 10.
Figure 12:
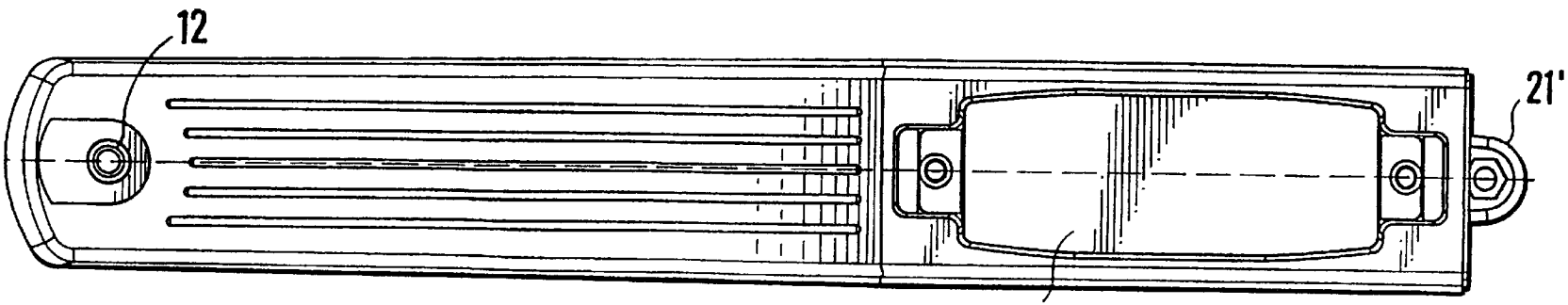
FIG. 12 is a top view of the rear foot extension in accordance with FIGS. 10 and 11.
Figure 13:
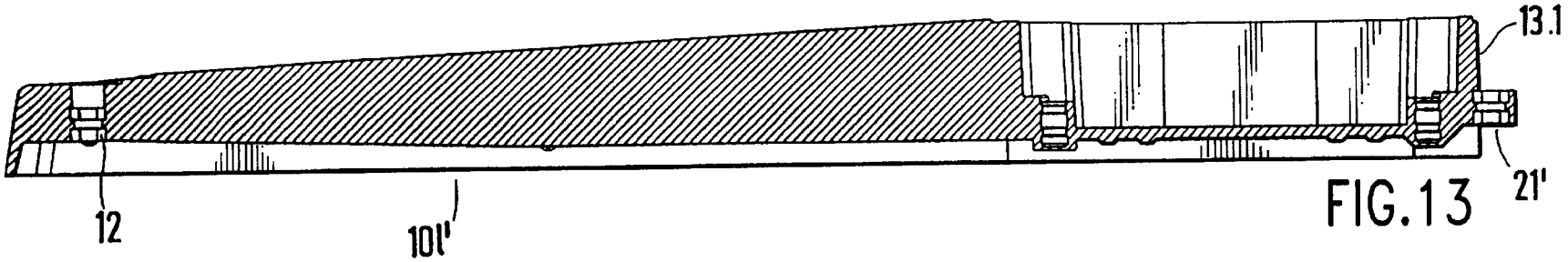
FIG. 13 is a longitudinal sectional view of a further embodiment of a long front foot extension.
Figure 14:
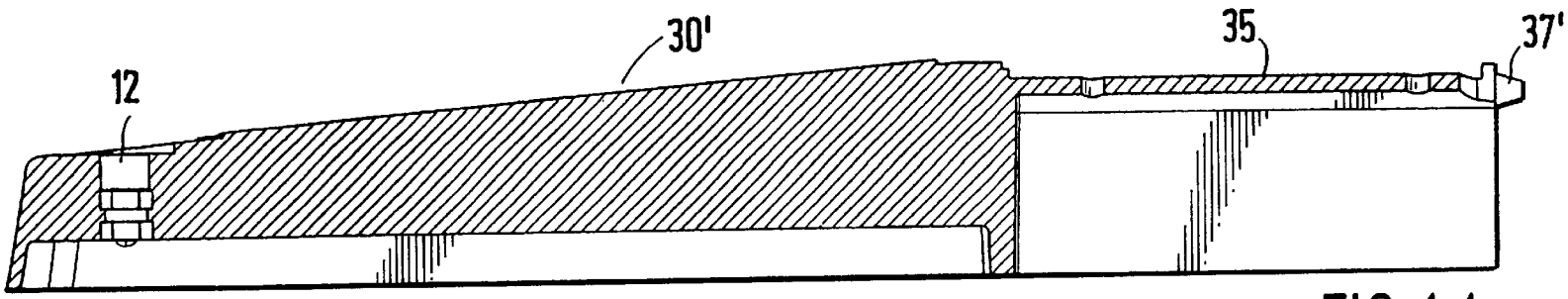
FIG. 14 is a further embodiment of a rear foot extension in a partial sectional lateral view.
Figure 15:
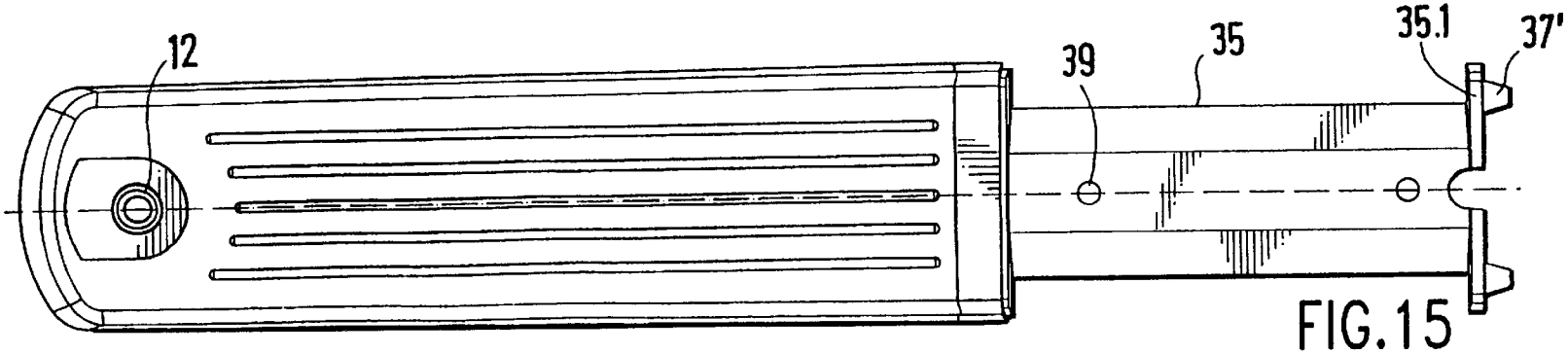
FIG. 15 is a top view of the rear foot extension in accordance with FIG. 14.
Figure 16:
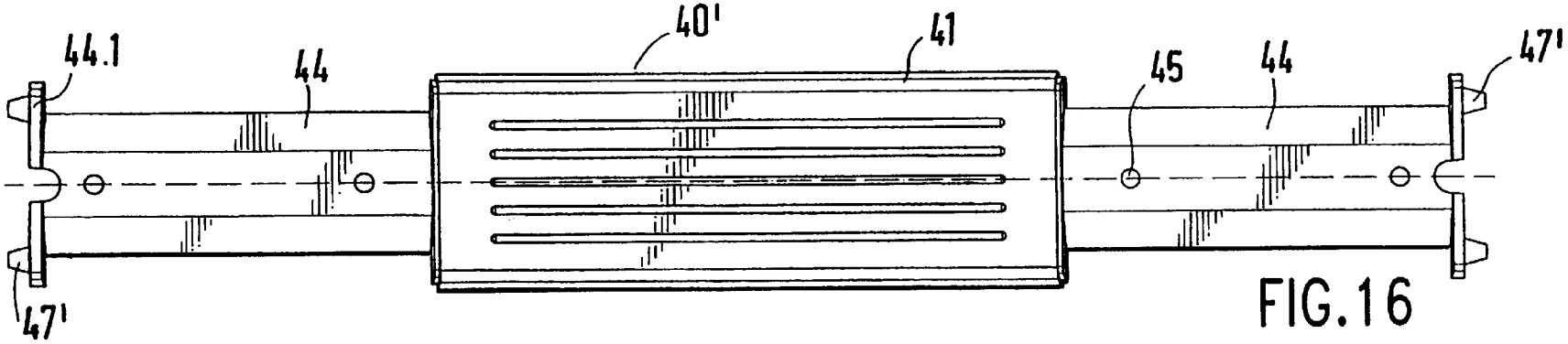
FIG. 16 is a longitudinal sectional view of a further embodiment of an intermediate foot element.
Figure 17:
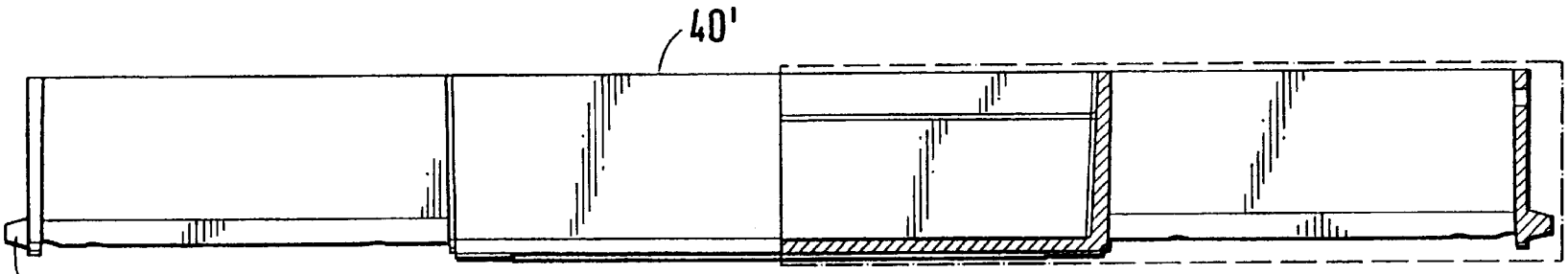
FIG. 17 is a lateral view of the intermediate foot element in accordance with FIG. 16.
Figure 18:
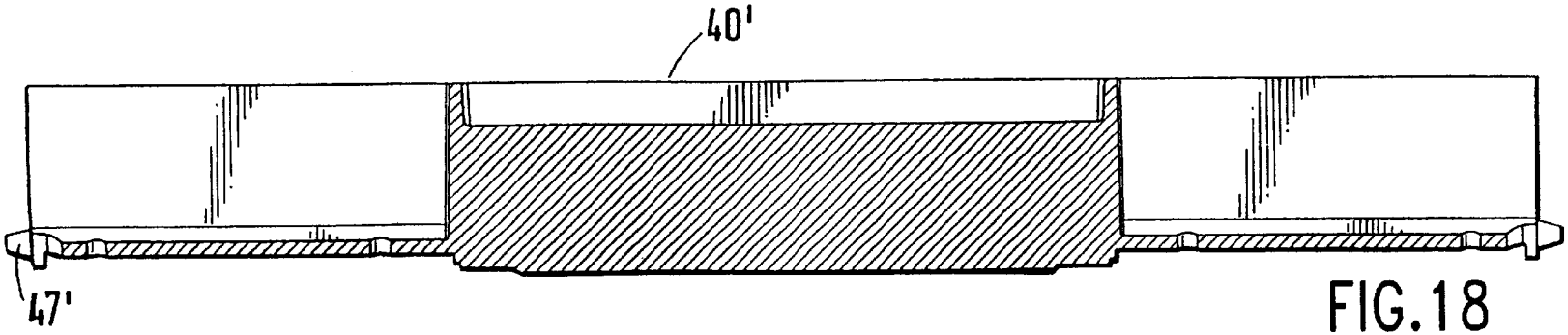
FIG. 18 is a longitudinal sectional view taken along line A—A of the intermediate foot element in accordance with FIGS. 16 and 17.

The basic construction of the foot with the front foot extensions 10*k'*, or 10*l'*, the rear foot extension 30', the intermediate foot element 40', as well as the connection with the column 20, essentially corresponds to the previous embodiment. The connection of the front foot extension 10*k'*, or 10*l'*, with the rear foot extension 30', or with the intermediate foot element 40' is embodied differently, as shown in FIGS. 10 and 19, which has an end face 13.1 oriented toward the rear foot extension 30', or the intermediate foot element 40', which has in the upper area conical pin receivers 28 and in the lower area screw receivers 13.2, such as threaded receivers or plug-through receivers. The side of the rear foot extension 30', or of the intermediate foot element 40', facing the end face 13.1, has plug-in pins 37' formed on it and matched to the pin receivers 28, wherein the side of the rear foot extension 30' and of the intermediate foot element 40' is embodied as a fastening plate 35.1 and has passages for connecting screws 35.2. Correspondingly, the end face of the intermediate foot element 40' is embodied as a fastening plate with the protruding plug-in pins 37'. A simple solid connection results from the pin and the pin receiver connection and the conical design of the same.

Fastening of the column 20 takes place in a manner corresponding to that of the first embodiment, wherein threaded receivers 16', 17' can be formed for a connection in the column receiver 13. A fastening element 21', formed on the end face of the front foot extensions 10*k'*, 10*l'*, is used for receiving a height adjustment element, for example, to compensate for any uneveness.

What is claimed is:

1. In a variable workstation furniture system having a furniture frame of vertical columns (20) and front foot extensions (10*k*, 10*l*; 10*k'*, 10*l'*) and lower ends of the columns (20) can be connected with base elements, to which rear foot extensions (30, 30') can be connected, and wherein the front foot extensions (10*k*, 10*l*; 10*k'*, 10*l'*) of different extension lengths, the rear foot extensions (30, 30') and intermediate foot elements (40, 40') form elements of a kit, the improvement comprising:

only the front foot extensions (10*k*, 10*l*; 10*k'*, 10*l'*) having a column receiver (13) facing the column (20), with the column receiver (13) formed in one piece and open at a top as one of the base elements into which the column (20) is inserted and directly connected with one of the front extensions (10*k*, 10*l*; or 10*k'*, 10*l'*); and one of the rear foot extension (30, 30') and the intermediate foot element (40, 40') which on an other end can be connected with a further one of the front foot extensions (10*k*, 10*l*; 10*k'*, 10*l'*) oriented in an opposite direction as a first of the front foot extensions (10*k*, 10*l*; 10*k'*, 10*l'*) which are connected to a column receiver (13) of one of front foot extensions (10*k*, 10*l*; 10*k'*, 10*l'*).

2. In the workstation furniture system in accordance with claim 1, wherein an extension element (11, 28) which is open toward a first bottom adjoins the column receiver (13) and has a fastening receiver (12) with a fastening plate (25) and a nut receptacle (24) in an area of a free end.

3. In the workstation furniture system in accordance with claim 2, wherein at least two fastening receivers (14, 15) with fastening flanges (18, 19) and one of nut receptacles (16, 17) and threaded receivers (16', 17'), to which the column (20) can be fixed by screws, are formed on a second bottom (27) of the column receiver (13).

4. In the workstation furniture system in accordance with claim 3, wherein a fastening sleeve (21) which can be brought into congruence with a fastening plate (36, 46) of one of a rear foot extension (30) and an intermediate foot element (20) and can be connected with a screw connection, is formed on the free end of the column receiver (13).

5. In the workstation furniture system in accordance with claim 4, wherein two plug-in receivers (22, 23) are formed in the area of the free end of the column receiver (13) of the front foot extension (10*k*, 10*l*), into which vertically upward oriented plug-in shoulders (37, 38, or 47, 48) of one of a rear foot extension (30) and an intermediate foot element (40) can be inserted.

6. In the workstation furniture system in accordance with claim 5, wherein the intermediate foot element (40) has identical fastening plates (46) and plug-in shoulders (47, 48) on both ends, and are the same as the fastening plate (36) and the plug-in shoulder (37, 38) of the rear foot extension (30).

7. In the workstation furniture system in accordance with claim 6, wherein the rear foot extension (30, 30') is designed as a hollow body open toward the bottom and is reinforced by at least one of longitudinal strips and transverse strips, and a fastening receiver (32) with a fastening plate (34) and a nut receptacle (35) is formed on a free end of the rear foot extension (30, 30').

8. In the workstation furniture system in accordance with claim 7, wherein the rear foot extension (30, 30') extends over a connecting element (35) and an extension element (31), and the extension element (31) is the same as the extension element (11, 28) of the front foot extension (10*k*, 10*l*; 10*k*', 10*l*') and is continuously reduced in structural height and width toward the free end.

9. In the workstation furniture system in accordance with claim 8, wherein the intermediate foot element (40, 40') extends over a connecting (44) element, a center element (41) and again the connecting element (44).

10. In the workstation furniture system in accordance with claim 9, wherein the connecting element (44) and the center element (41) of the intermediate foot element (40) are designed as hollow bodies open toward the bottom and are reinforced by at least one of longitudinal strips and transverse strips, and the center element (41) has a centered screw receiver (42) with a threaded bore (43).

11. In the workstation furniture system in accordance with claim 10, wherein the column receiver (13) of the front foot extension (10*k*, 10*l*) is designed for insertion and connection with a double support.

12. In the workstation furniture system in accordance with claim 11, wherein a fastening element (21') which extends horizontally away and has a vertical bore, to which a height adjustment device is attached, is formed on the free end of the column receiver (13).

13. In the workstation furniture system in accordance with claim 12, wherein horizontally oriented one of pins and pin receivers (28) and screw receivers are provided on a connecting face of the free end of the column receiver (13) of the front foot extension (10*k*', 10*l*'), and one of the pin receivers and the pins (37', 47') adapted as counter elements and screw receivers are formed on a side of one of the rear foot extension (30') and the intermediate foot element (40'), facing a connecting face.

14. In the workstation furniture system in accordance with claim 13, wherein the pins (37', 47') and the pin receivers (28) are conically shaped.

15. In the workstation furniture system in accordance with claim 1, wherein at least two fastening receivers (14, 15) with fastening flanges (18, 19) and one of nut receptacles (16, 17) and threaded receivers (16', 17'), to which the column (20) can be fixed by screws, are formed on a second bottom (27) of the column receiver (13).

16. In the workstation furniture system in accordance with claim 1, wherein a fastening sleeve (21) which can be brought into congruence with a fastening plate (36, 46) of one of a rear foot extension (30) and an intermediate foot element (20) and can be connected with a screw connection, is formed on a free end of the column receiver (13).

17. In the workstation furniture system in accordance with claim 1, wherein two plug-in receivers (22, 23) are formed in an area of a free end of the column receiver (13) of the front foot extension (10*k*, 10*l*), into which vertically upward oriented plug-in shoulders (37, 38, or 47, 48) of one of a rear foot extension (30) and an intermediate foot element (40) can be inserted.

18. In the workstation furniture system in accordance with claim 1, wherein the intermediate foot element (40) has identical fastening plates (46) and plug-in shoulders (47, 48) on both ends, and are the same as a fastening plate (36) and a plug-in shoulder (37, 38) of the rear foot extension (30).

19. In the workstation furniture system in accordance with claim 1, wherein the rear foot extension (30, 30') is designed as a hollow body open toward a bottom and is reinforced by at least one of longitudinal strips and transverse strips, and a fastening receiver (32) with a fastening plate (34) and a nut receptacle (35) is formed on a free end of the rear foot extension (30, 30').

20. In the workstation furniture system in accordance with claim 19, wherein the rear foot extension (30, 30') extends over a connecting element (35) and an extension element (31), and the extension element (31) is the same as a second extension element (11, 28) of the front foot extension (10*k*, 10*l*; 10*k*', 10*l*') and is continuously reduced in structural height and width toward the free end.

21. In the workstation furniture system in accordance with claim 1, wherein the intermediate foot element (40, 40') extends over a connecting (44) element, a center element (41) and again the connecting element (44).

22. In the workstation furniture system in accordance with claim 21, wherein the connecting element (44) and the center element (41) of the intermediate foot element (40) are designed as hollow bodies open toward a bottom and are reinforced by at least one of longitudinal strips and transverse strips, and the center element (41) has a centered screw receiver (42) with a threaded bore (43).

23. In the workstation furniture system in accordance with claim 1, wherein the column receiver (13) of the front foot extension (10*k*, 10*l*) is designed for insertion and connection with a double support.

24. In the workstation furniture system in accordance with claim 1, wherein a fastening element (21') which extends horizontally away and has a vertical bore, to which a height adjustment device is attached, is formed on a free end of the column receiver (13).

25. In the workstation furniture system in accordance with claim 1, wherein horizontally oriented one of pins and pin receivers (28) and screw receivers are provided on a connecting face of a free end of the column receiver (13) of the front foot extension (10*k*', 10*l*'), and one of the pin receivers and pins (37', 47') adapted as counter elements and screw receivers are formed on a side of one of the rear foot extension (30') and the intermediate foot element (40'), facing a connecting face.

26. In the workstation furniture system in accordance with claim 25, wherein the pins (37', 47') and the pin receivers (28) are conically shaped.

* * * * *